US010494964B2

(12) United States Patent
Heckman et al.

(10) Patent No.: US 10,494,964 B2
(45) Date of Patent: Dec. 3, 2019

(54) OIL PAN HAVING SMALL ACTIVE VOLUME OIL RESERVOIR AND METHODS OF USING THE SAME

(71) Applicant: GM GLOBAL TECHNOLOGY OPERATIONS LLC, Detroit, MI (US)

(72) Inventors: Brad J. Heckman, Unionville, MI (US); Alan W. Hayman, Romeo, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 143 days.

(21) Appl. No.: 15/490,347

(22) Filed: Apr. 18, 2017

(65) Prior Publication Data

US 2018/0298797 A1 Oct. 18, 2018

(51) Int. Cl.

| | |
|---|---|
| ***F01M 11/00*** | (2006.01) |
| ***F01M 1/16*** | (2006.01) |
| *F01M 11/04* | (2006.01) |
| *F01M 5/02* | (2006.01) |

(52) U.S. Cl.

CPC ..... *F01M 11/0004* (2013.01); *F01M 1/16* (2013.01); *F01M 11/0408* (2013.01); *F01M 2005/023* (2013.01); *F01M 2011/0033* (2013.01); *F01M 2011/0087* (2013.01)

(58) Field of Classification Search

CPC .. F01M 11/0004; F01M 1/16; F01M 11/0408; F01M 2011/0033; F01M 2011/0087; F01M 2005/023; F16C 33/6685

USPC ..... 123/196 R, 198 E

See application file for complete search history.

(56) References Cited

U.S. PATENT DOCUMENTS

| | | | | |
|---|---|---|---|---|
| 5,038,890 A * | 8/1991 | Tanaka | F01M 11/0004 | 123/196 R |
| 6,019,071 A * | 2/2000 | Maciejka, Jr. | F01M 11/0004 | 123/195 H |
| 6,340,012 B1 * | 1/2002 | Yamashita | F01M 11/0004 | 123/195 C |
| 2016/0245134 A1 * | 8/2016 | Zahdeh | F01M 11/0004 | |

* cited by examiner

*Primary Examiner* — Syed O Hasan

(57) ABSTRACT

Provided are oil reservoirs and engine oil circulation systems including an upper sump capable of receiving oil from an engine, a lower sump disposed vertically below the upper sump, a valve-controlled orifice (VCO) penetrating the upper sum bottom, an oil chimney capable of receiving oil and communicating oil to the lower sump, and an oil conduit capable of extracting oil from the lower sump. Methods for operating systems include maintaining the VCO in an open position for a draw down duration temporally proximate an engine cold start, subsequently circulating oil between the engine and the oil reservoir, actuating the VCO to a closed position subsequent to the draw down duration for a warmup duration, and actuating the VCO to an open position subsequent to the warmup duration. Methods can further include actuating the VCO to an open position during the warmup duration in response to an increased oil demand event.

20 Claims, 7 Drawing Sheets

OIL PAN HAVING SMALL ACTIVE VOLUME OIL RESERVOIR AND METHODS OF USING THE SAME

BACKGROUND

An oil pan can collect oil used to lubricate an internal combustion engine. During operation of the internal combustion engine (ICE), oil may circulate within the internal combustion engine to lubricate moving components thereof, dissipate thermal energy, and protect against wear of the ICE. After lubricating the moving parts of the engine, the oil is collected by the oil pan. Thermal management of ICEs and engine oil remains a challenge, particularly during ICE cold starts.

SUMMARY

In one or more embodiments an oil reservoir is provided, including an upper sump defined by a sump bottom and one or more side walls, and including an at least partially open top end capable of receiving oil, a lower sump disposed vertically below the upper sump including a top end contiguous with at least a portion of the upper sump bottom, a valve-controlled orifice penetrating the upper sum bottom and capable of controlling fluid communication between the upper sump and the lower sump, an oil chimney having an inlet end capable of receiving oil and a discharge end in fluid communication with the lower sump and capable of providing oil thereto, and an oil pump conduit having an inlet end disposed within the lower sump, and capable of extracting oil therefrom. The oil reservoir can further include a drip tray disposed proximate the open top end of the upper sump and at least partially between the open top end and the upper sump bottom. The drip tray can be capable of collecting at least a portion of oil communicated to the oil reservoir proximate the upper sump open top end and further capable of communicating the collected oil to the oil chimney. The reservoir can further include a windage tray disposed above the drip tray relative to the upper sump and capable of communicating oil to the drip tray. The upper sump bottom can further include a bleed hole capable of establishing fluid communication between the upper sump and the lower sump. The lower sump can have a smaller fluid capacity than the upper sump.

In one or more embodiments an internal combustion engine (ICE) oil circulation system is provided, including an ICE capable of receiving and discharging oil, and an oil reservoir. The oil reservoir can include an upper sump defined by a sump bottom and one or more side walls and an at least partially open top end capable of receiving oil from the ICE, a lower sump disposed vertically below the upper sump including a top end contiguous with at least a portion of the upper sump bottom, a valve-controlled orifice penetrating the upper sum bottom and capable of controlling fluid communication between the upper sump and the lower sump, an oil chimney having an inlet end capable of receiving oil and a discharge end in fluid communication with the lower sump, and capable of providing oil thereto, and an oil pump conduit having an inlet end disposed within the lower sump and configured to extract oil from the lower sump and communicate the same to the ICE. The upper sump bottom can further include a bleed hole capable of establishing fluid communication between the upper sump and the lower sump. The system can further include a drip tray disposed proximate the open top end of the upper sump and at least partially between the open top end and the supper sump bottom, wherein the drip tray is capable of collecting at least a portion of oil communicated to the oil reservoir proximate the upper sump open top end and further capable of communicating the collected oil to the oil chimney. The system can further include a windage tray disposed above the drip tray relative to the upper sump, and capable of communicating oil to the drip tray. One of more of the drip tray or oil reservoir can be angled such that at least a portion of the oil collected by the drip tray is directed to the oil chimney by virtue of gravity.

Methods for operating the ICE oil circulation systems described above are provided. The methods can include maintaining the valve-controlled orifice in an at least partially open position for a draw down duration temporally proximate an ICE cold start event, circulating oil between the ICE and the oil reservoir via the oil pipe conduit after the ICE cold start event, actuating the valve-controlled orifice to a substantially closed position subsequent to the draw down duration for a warmup duration, and actuating the valve-controlled orifice to an at least partially open position subsequent to the warmup duration. At least a portion of the draw down duration can occur after the cold start event. The draw down duration can include a period of time sufficient to allow a rate of oil transfer from the ICE to the lower sump via the oil chimney to achieve a rate substantially equal to a rate of oil extraction from the lower sump via the oil pipe conduit. The rate of oil extraction from the lower sump via the oil pipe conduit can be an average rate measured over a period of time. The draw down duration can expire after the oil achieves a minimum temperature and/or viscosity threshold. The warmup duration can expire after the oil achieves a minimum temperature and/or viscosity threshold. Maintaining the valve-controlled orifice in an at least partially open position can further include actuating the valve-controlled orifice from a substantially closed position to an at least partially open position. The methods can further include actuating the valve-controlled orifice to an open position during the warmup duration in response to an increased oil demand event. The ICE oil circulation system can be controlled by a throttle and the throttle can be monitored by a throttle position sensor, and, in such an embodiment, the increased oil demand event can include the throttle position sensor exceeding a position threshold. The ICE oil circulation system can power a vehicle and the vehicle can be controlled by a brake system, and, in such an embodiment, the increased oil demand event can include a braking event. The ICE oil circulation system can include a crankshaft, and, in such an embodiment, the increased oil demand event can include the crankshaft exceeding a rotations per minute threshold.

Other objects, advantages and novel features of the exemplary embodiments will become more apparent from the following detailed description of exemplary embodiments and the accompanying drawings.

DETAILED DESCRIPTION

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the present invention. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
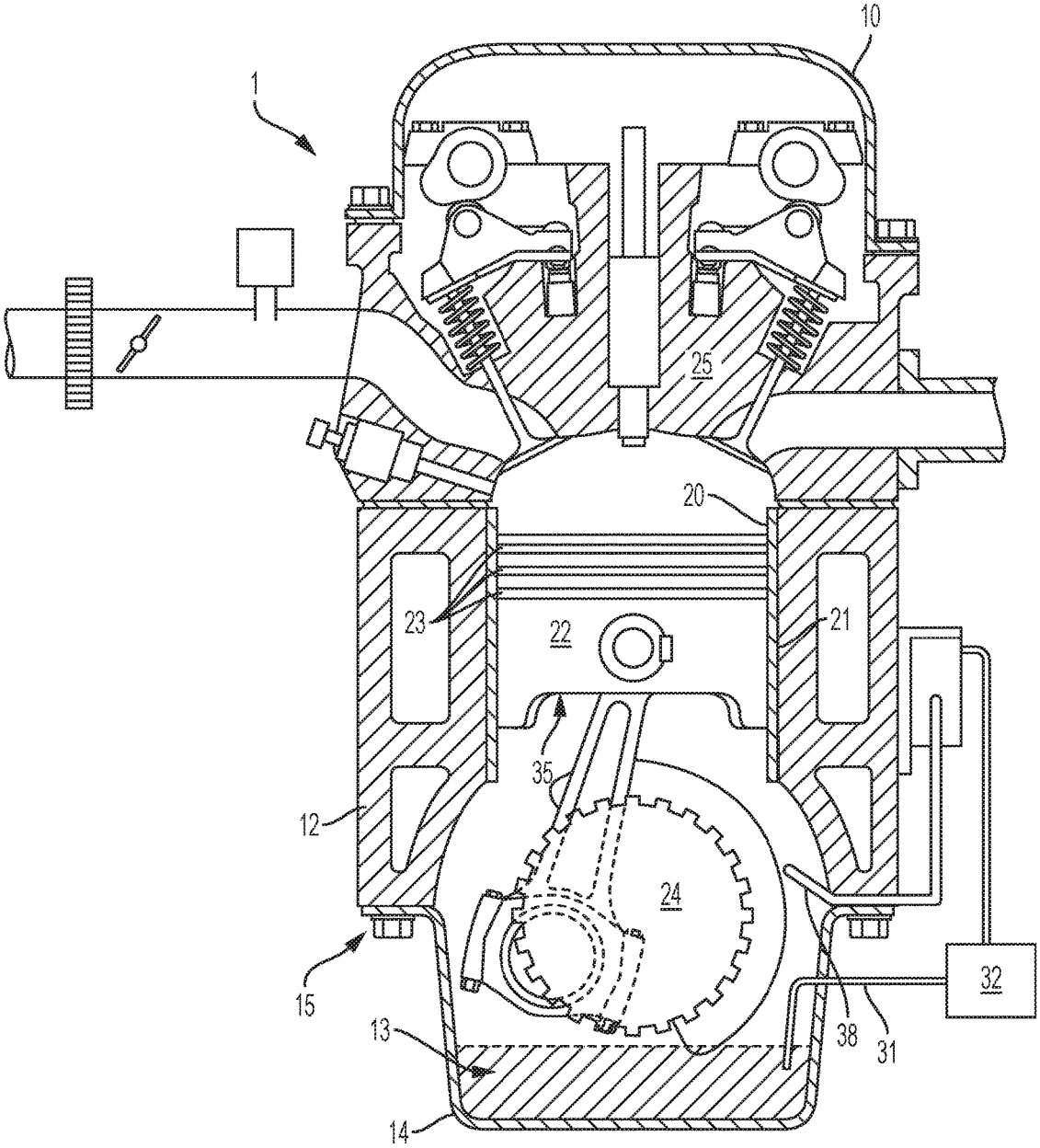
FIG. 1 illustrates a cross-sectional side view of an internal combustion engine oil circulation system, according to one or more embodiments.

Provided herein are small active volume oil reservoirs and internal combustion engine (ICE) oil circulation systems incorporating the same. Further provided herein are methods for operating ICE oil circulation systems incorporating small active volume oil reservoirs. Referring to the drawings, wherein like reference numbers correspond to like or similar components throughout the several figures, FIG. 1 illustrates a schematic diagram of an ICE oil recirculation system 1. System 1 includes an ICE 10, which can comprise any suitable single or multi-cylinder ICE. ICE 10 includes an engine block 12 and a cylinder head 25. The engine block 12 includes one or a plurality of cylinders 20 formed therein. Walls 21 of each of the cylinders 20 may include a cylinder liner. Each of the cylinders 20 accommodates a reciprocating piston 22 that attaches to a crankshaft 24. Each piston 22 can include one or more rings 23. Crankshaft 24 can mechanically couple to a vehicle transmission and driveline to deliver tractive torque thereto in response to an operator torque request. The crankshaft 24 rotatably attaches to a lower portion 15 of the engine block 12 using main bearings, for example. An oil reservoir 14 attaches to the lower portion 15 of the engine block 12 and encases the crankshaft 24 and the lower portion 15 of the engine block 12. ICE 10 is depicted as a direct-injection spark ignition engine, but the disclosure is not intended to be limited thereto.

System 1 further includes an oil reservoir 14 generally includes an oil sump area 13 for storing and collecting engine oil that drains from ICE 10, and will be described in greater detail below. Specifically, oil sump area 13 is depicted in FIG. 1 in simplified form for clarity only. Oil pump 32 is capable of fluidly connecting oil within sump area 13 to ICE 10 via an oil pump conduit 31. Oil pump conduit 31 can communicate oil to one or more oil jets 38 configured to spray oil onto internal engine surfaces 35. The orientation of oil jet 38 is provided for illustration only, and is not intended to limit the scope of this disclosure. Oil communicated onto internal engine surfaces 35 can dissipate heat therefrom, and lubricate the various rotating and translating engine components. In one embodiment, the internal engine surface 35 includes underside portions of the pistons 22, but can include various other additional or alternative ICE 10 components and areas without limitation. After oil is delivered to one or more internal ICE surfaces 35, the oil is subsequently communicated by gravity and/or movement of one or more ICE 10 components, including components which are not shown, downward towards oil reservoir 14 whereafter the oil is collected a recirculated to ICE 10.

Figure 2:
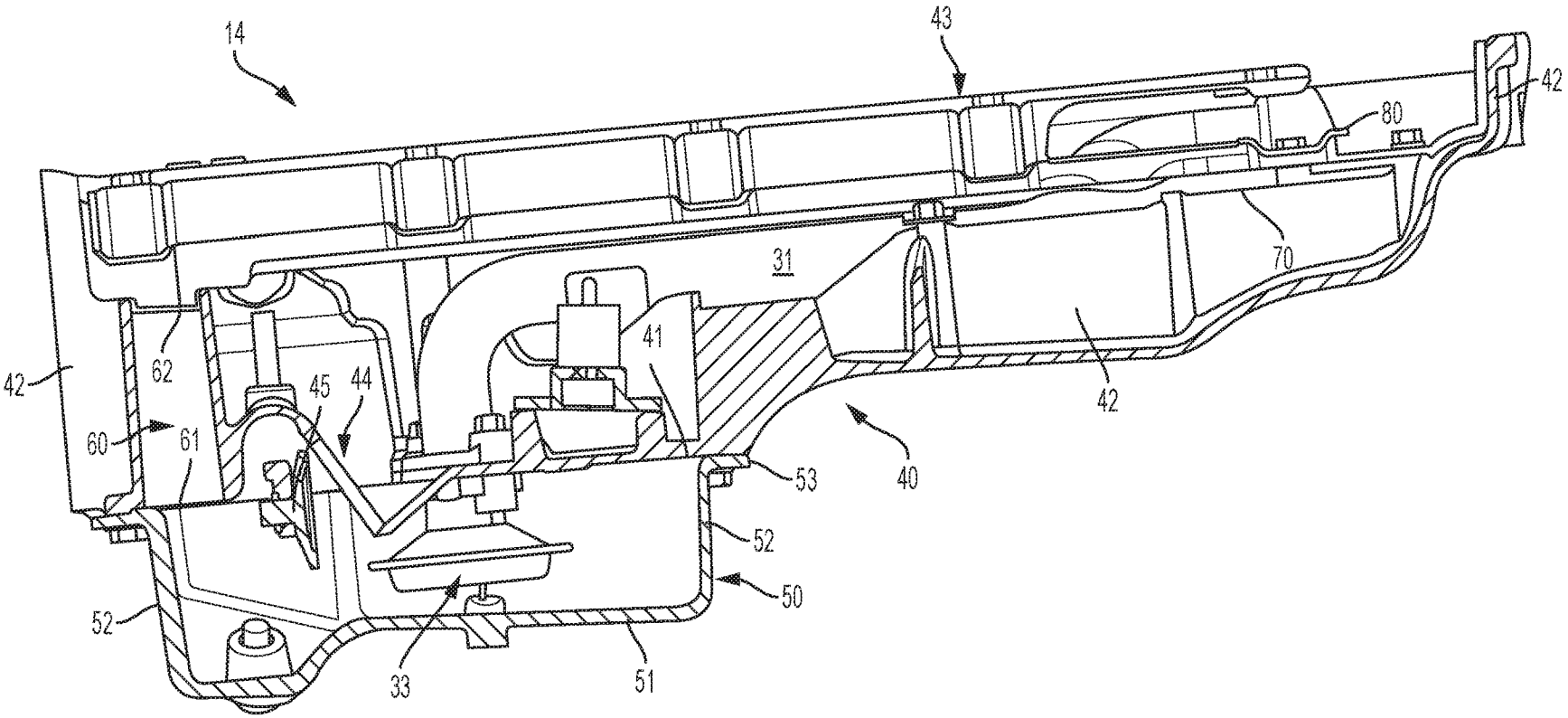
FIG. 2 illustrates a cross-sectional side view of an oil reservoir, according to one or more embodiments.
Figure 3:
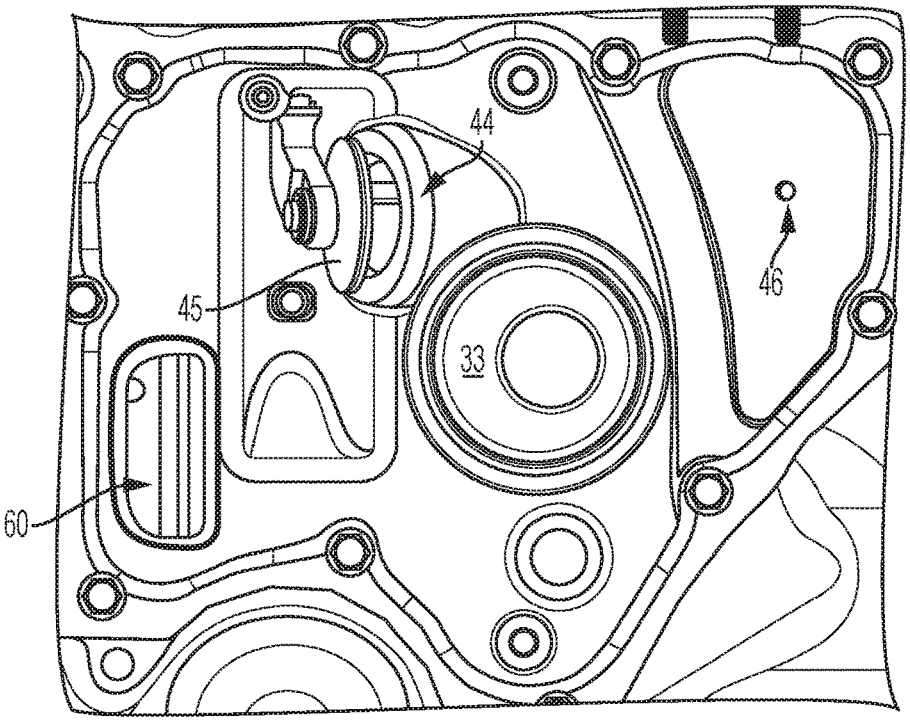
FIG. 3 illustrates a bottom view of an oil reservoir upper sump bottom, according to one or more embodiments.
Figure 4:
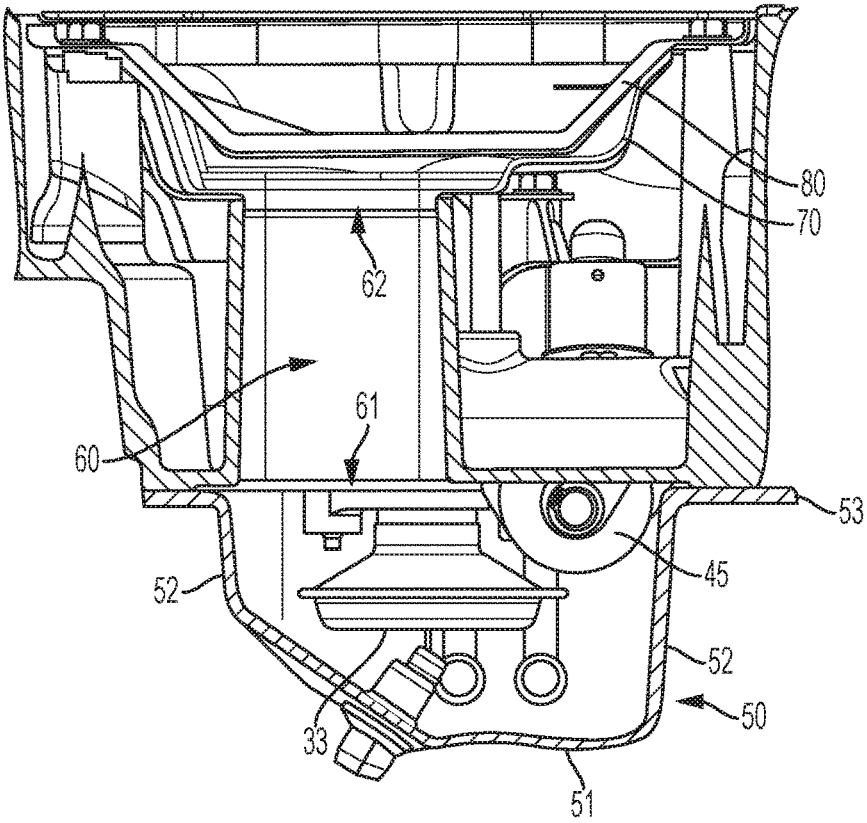
FIG. 4 illustrates a cross-sectional side view of an oil reservoir, according to one or more embodiments.
Figure 5:
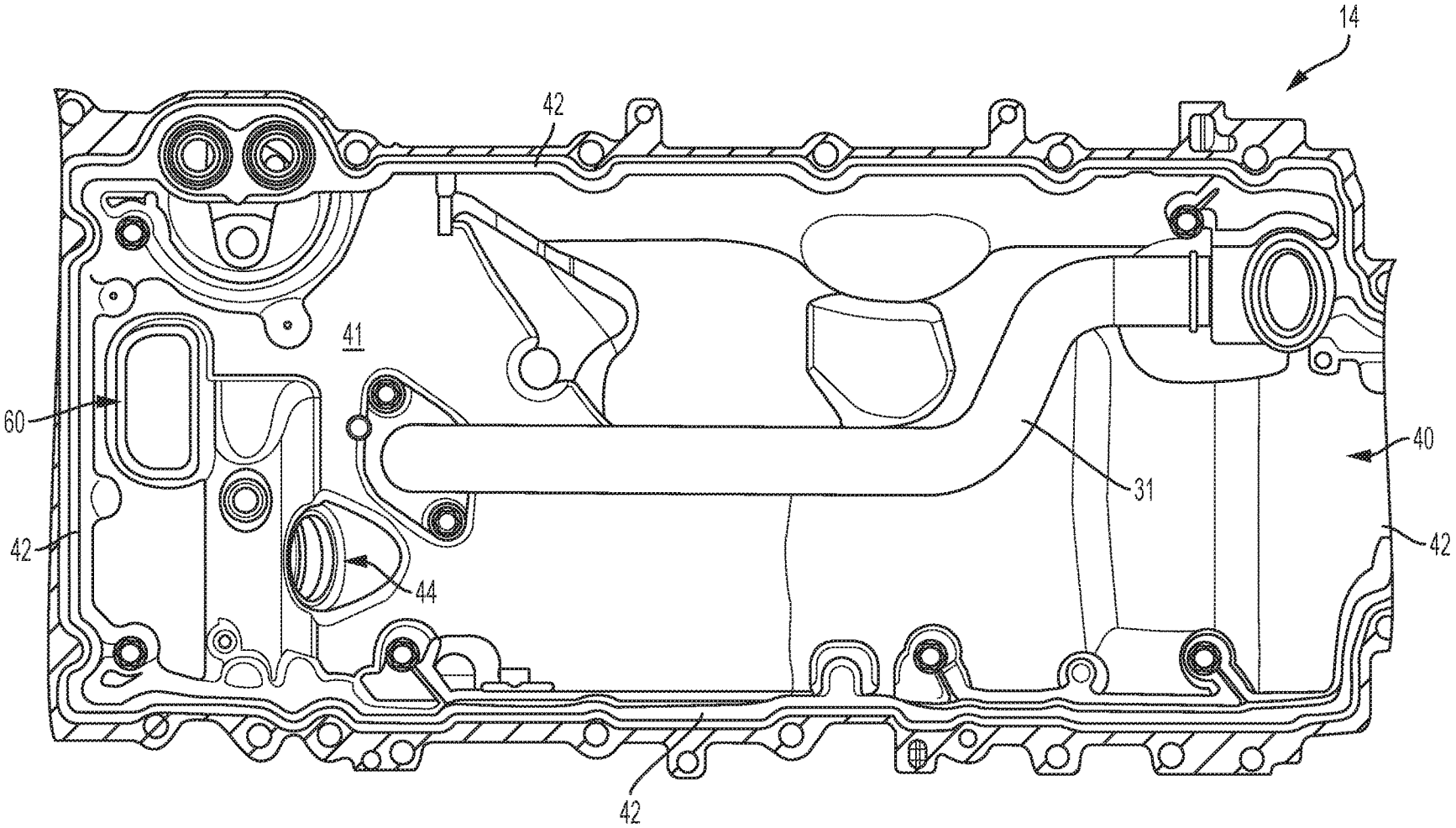
FIG. 5 illustrates a top view of an oil reservoir upper sump, according to one or more embodiments.

FIG. 2 illustrates a cross-sectional side view of oil reservoir 14. FIG. 3 illustrates a bottom view of upper sump 40 bottom 41, and FIG. 4 illustrates a cross-sectional side view of oil reservoir 14. Reservoir 14 is a small active volume oil reservoir (SAVOR) as will be described below. Reservoir 14 generally includes an upper sump 40, and a lower sump 50 disposed generally below upper sump 40. Each of upper sump 40 and lower sump 50 defines a respective sump volume which is generally capable of retaining fluid, such as oil. The sump volume of lower sump 50 can be smaller than the sump volume of upper sump 40, in some embodiments. For example, in a specific embodiment upper sump 40 can comprise a sump volume of 6.5 quarts, and lower sump 50 can comprise a sump volume of 1.5 quarts. Upper sump 40 is generally defined by a bottom 41 and one or more side walls 42, and includes an open top end 43 generally capable of receiving oil. Top end 43 can be oriented proximate the bottom of an ICE, such as ICE 10 to collect oil therefrom, for example. Lower sump is generally defined by a bottom 51, and one or more side walls 52. Lower sump 50 includes a top end 53 contiguous with or substantially contiguous with at least a portion of the upper sump 40 bottom 41. Upper sump 40 and lower sump 50 can collectively embody the oil sump area 13 depicted in FIG. 1. FIG. 5 illustrates a top view of oil reservoir 14 upper sump 40, according to one or more embodiments.

Upper sump 40 further includes a valve-controlled orifice 44 penetrating the upper sump 40 bottom 41 and is capable of controlling fluid communication between upper sump 40 and lower sump 50 by actuating to and/or between one or more of an open position and a closed position. Valve-controlled orifice 44 can include an actuatable wastegate 45, the disposition of which can define an open position, a closed position, or positions therebetween. An open position can be defined as the position in which the valve-controlled orifice 44 permits the greatest degree of fluid communication between upper sump 40 and lower sump 50, and a closed position can be defined as the position in which the valve-controlled orifice 44 permits the least degree of fluid communication between upper sump 40 and lower sump 50, or no fluid communication at all. Valve-controlled orifice 44 can be fail-open, in that a failure will cause the valve-controlled orifice 44 to assume an open, or substantially open position. Upper sump 40 bottom 41 can further comprise a bleed hole capable of establishing fluid communication between upper sump 40 and lower sump 50. The bleed hole can be up to about 3 mm, up to about 6 mm, or up to about 10 mm, for example. Fluid communication can occur from upper sump 40 to lower sump 50 (e.g., via one or more of valve-controlled orifice 44 or bleed hole 46) by virtue of gravity. In some embodiments, when paired with an ICE, such as ICE 10, reservoir 14 can be angled relative to the ICE in order to direct oil received by reservoir towards oil chimney 60, for example. Additionally or alternatively, one or more of the drip tray 70 and windage tray 80 can be angled relative to an ICE. The angle of one or more of reservoir 14, drip tray 70, and windage tray 80 relative to an ICE can comprise about 2 degrees to about 10 degrees, about 4 degrees to about 7 degrees, or about 5 degrees to about 6 degrees, for example.

Reservoir 14 further includes an oil chimney 60 having a discharge end 61 in fluid communication with lower sump 50, and is capable of providing oil thereto. Oil chimney 60 further includes an inlet end 62 capable of receiving oil. Inlet end 62 is capable of receiving at least a portion of oil collected by reservoir 14, such as oil received via upper sump 40 top end 43. Oil chimney 60 can optionally penetrate upper sump 40 bottom 41 as shown in FIG. 5. Reservoir further includes an oil pump conduit 31 having an inlet end 33 disposed within lower sump 50. Oil pump conduit 31 is shown penetrating upper sump 40 bottom 41, however in some embodiments, oil pump conduit 31 inlet end 33 can be contiguous or proximate a lower sump 50 wall aperture. Oil pump conduit 31 inlet end 33 is capable of receiving oil from lower sump 50, or extracting oil therefrom, for example via oil pump 32. Oil pump conduit 31 is further capable of communicating oil to an ICE, such as ICE 10, or at least partially facilitating the transfer of oil to an ICE.

Figure 6:
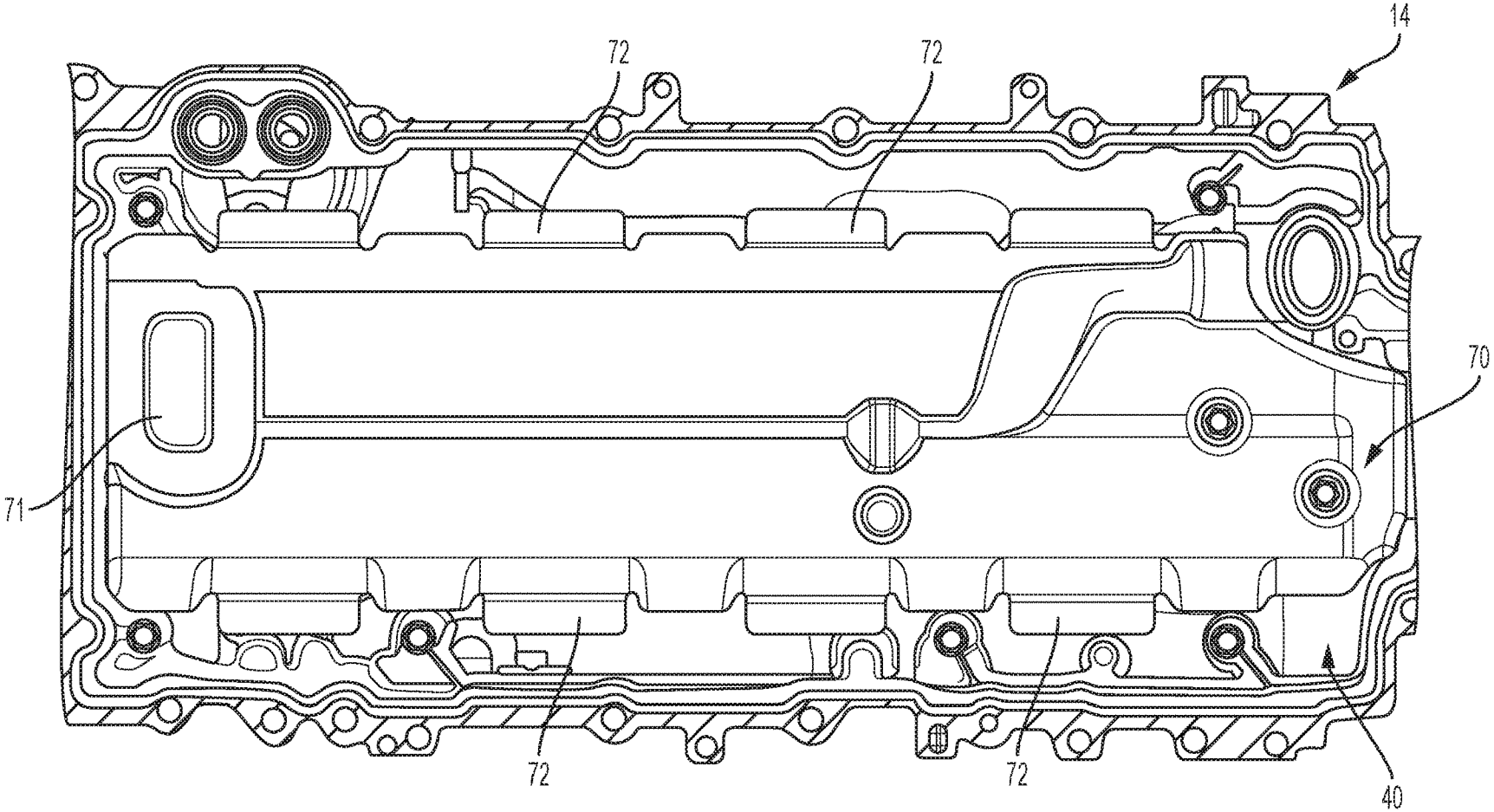
FIG. 6 illustrates a top view of an oil reservoir upper sump and drip tray, according to one or more embodiments.

Reservoir 14 can further include a drip tray. FIG. 6 illustrates a top view of reservoir 14 upper sump 40 and drip tray 70, disposed proximate the upper sump 40 top end 43. Drip tray 70 can be disposed at least partially between top end 43 and upper sump 40 bottom 41. In some embodiments, drip tray 70 can be fully disposed between top end 43 and upper sump 40 bottom 41. Drip tray 70 can cover less than the entire open top end 43 of upper sump 40, as shown in FIG. 6. Drip tray 70 is capable of receiving at least a portion of oil collected by reservoir 14 via upper sump 40 top end 43. Drip tray 70 can include a drip aperture 71 configured to communicate at least a portion of the oil collected by the drip tray 70 to the oil chimney 60 inlet end 62. Oil chimney 60 inlet end 62 can be positioned proximate to or contiguous with drip tray 70 drip aperture 71, for example.

Figure 7:
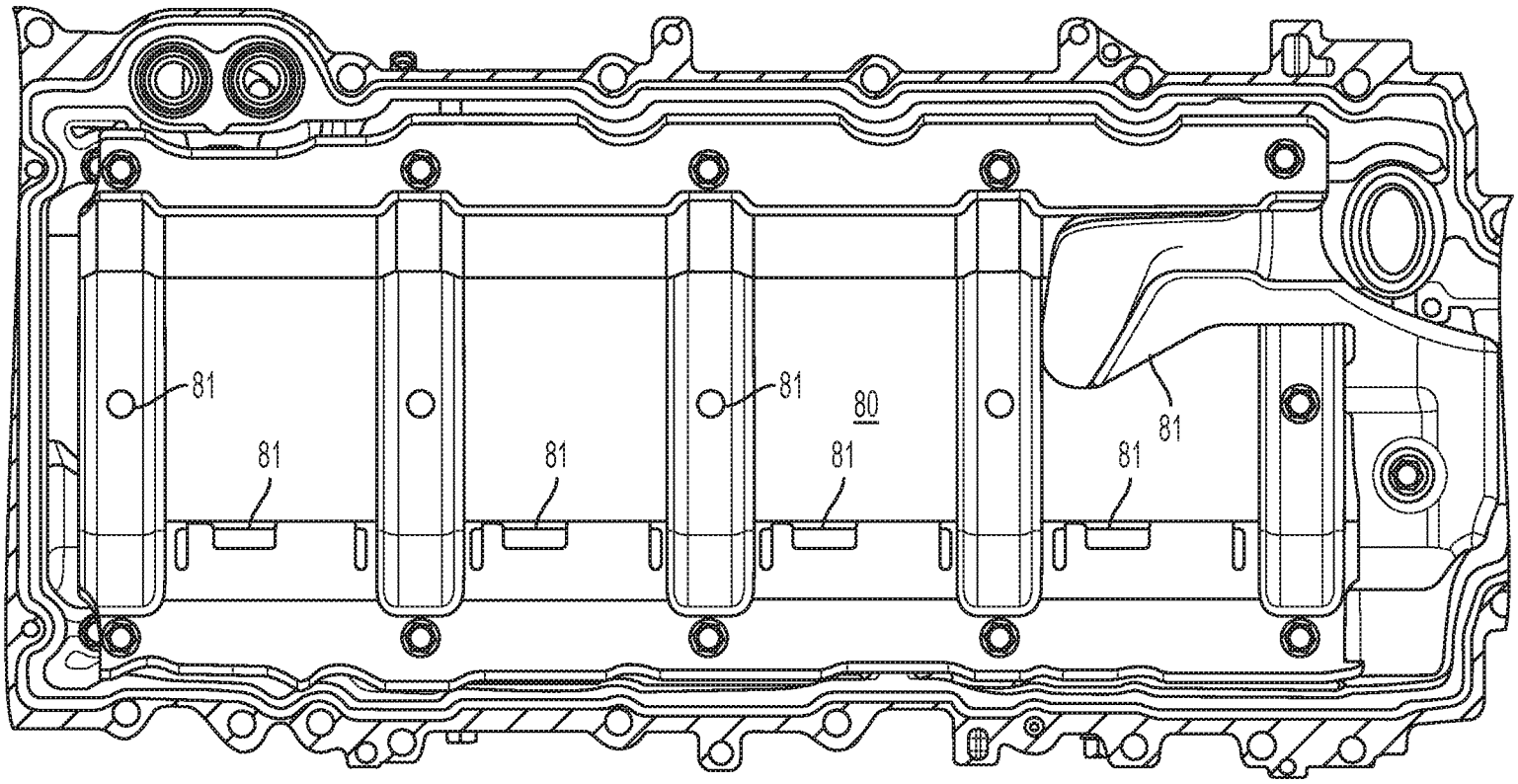
FIG. 7 illustrates a top view of an oil reservoir upper sump and windage tray, according to one or more embodiments.

Reservoir 14 can further include a windage tray. FIG. 7 illustrates a top view of windage tray 80 disposed above drip tray 70 relative to upper sump 40, the orientation of which can further be seen in FIGS. 2 and 4. In some embodiments, windage tray 80 acts as the general oil inlet for reservoir 14. Windage tray 80 can advantageously prevent or reduce oil frothing within upper sump 40, for example. Windage tray 80 is capable of receiving at least a portion of oil collected by reservoir 14 via upper sump 40 top end 41, and is capable of communicating at least a portion of the same to drip tray 70. Windage tray 80 can include one or more apertures 81 for communicating oil to drip tray 70, for example. Drip tray can attach to windage tray 80 via one or more tabs 72, for example. A portion of the oil collected by windage tray 80 can be communicated to upper sump 40, rather than drip tray 70, by virtue of the position and/or shape of drip tray 70 relative to windage tray 80.

Reservoir 14 can be utilized in ICE oil circulation systems, such as system 1, and can advantageously improve thermal management of oil during ICE cold starts and in generally cold operating conditions. As used herein, a cold start refers to an ICE start that occurs while the temperature of oil in the ICE oil recirculation system is lower than the ideal or suitable operating temperature of oil. The temperature of the oil can refer to the average temperature of the oil (i.e., the oil located in the ICE and in the oil reservoir), or the temperature of the oil in the oil reservoir. Additionally or alternatively a cold start can be identified by an ambient temperature threshold (e.g., below 40° C.), or an ambient temperature less than an ideal or suitable operating temperature of the oil. During a cold start, the low temperature of the oil can retard engine efficiency, particularly immediately after a cold start where the temperature differential between the ICE and oil is low and, accordingly, the heat transfer rate between the ICE and the oil is at or near a minimum rate. Specifically, colder oil can increase friction between ICE components and exacerbate and/or protract parasitic losses within ICE oil circulation system 1. The SAVORs, such as reservoir 14, and ICE oil circulation systems, such as system 1, and methods for controlling the same provided herein allow for rapid heating of oil after ICE cold starts, and improve the efficiency of ICEs and appurtenant vehicles.

Figure 8:
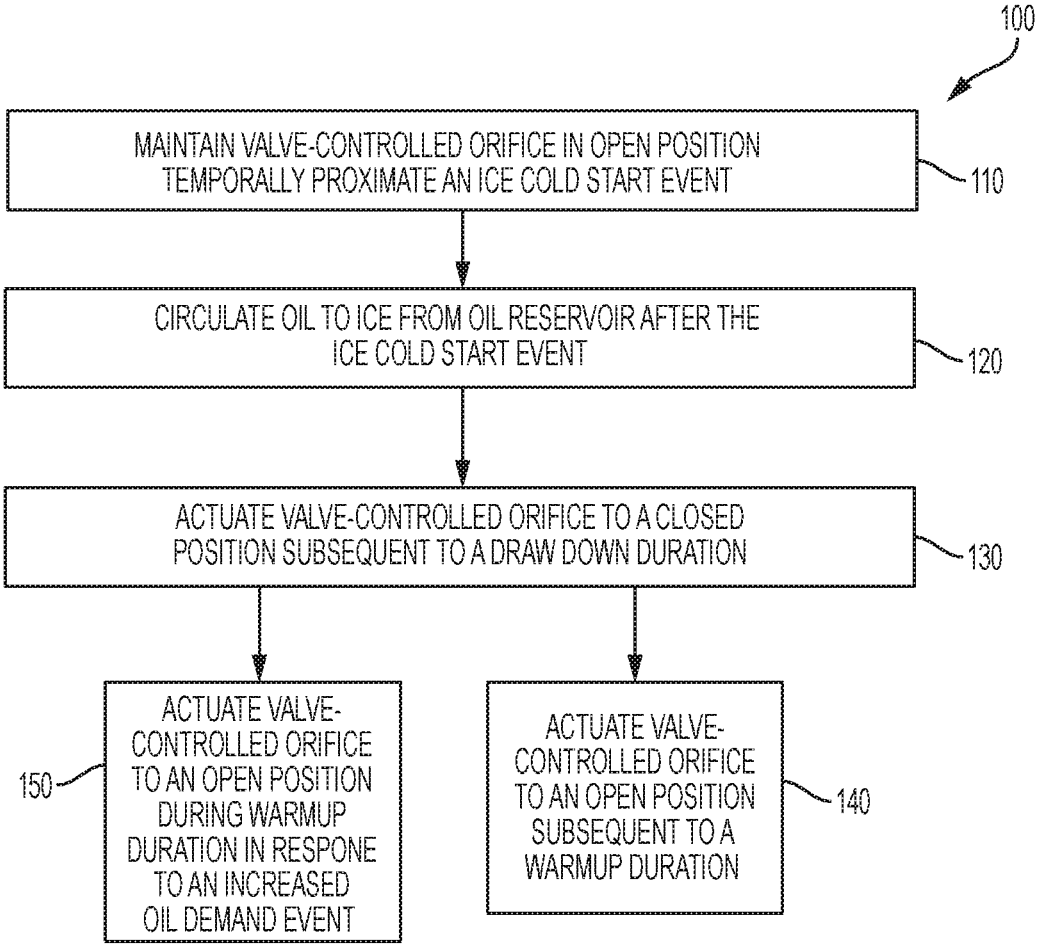
FIG. 8 illustrates a schematic of a method for operating an internal combustion engine oil circulation system, according to one or more embodiments.

FIG. 8 a schematic of a method 100 for operating an ICE oil circulation system. Method 100 utilizes the split active volume characteristics of reservoir 14 to circulate a reduced volume of oil relative to the total volume of oil present in system 1 in order to accelerate heating of the reduced volume of oil. Specifically, the partitioning characteristics of reservoir 14 allow for oil to be circulated exclusively or substantially out of lower sump 14. Method 100 will be described in reference to system 1 and reservoir 14 for the purposes of illustration and clarity only, and the scope of method 100 is not to be limited to the particularly limitations thereof. Method 100 comprises maintaining 110 the valve-controlled orifice in an open position for a draw down duration temporally proximate an ICE 10 cold start event, circulating 120 oil between ICE 10 and reservoir 14 after the ICE 10 cold start event, actuating 130 the valve-controlled orifice 44 to a closed position subsequent to the draw down duration for a warmup duration, and actuating 140 the valve-controlled orifice 44 to an at least partially open position subsequent to the warmup duration.

At any given time of operation or non-operation of ICE 10, a portion of the oil is present in reservoir 14 and another portion of the oil is present outside of the reservoir, such as within one or more of oil pump conduit 31, oil pump 32, and ICE 10. Oil present outside of the reservoir can be referred to as the drawdown oil. Subsequent to, and particularly temporally proximate, an ICE 10 start, the rate of oil extraction from lower sump 50 to ICE 10 can be higher than the rate of oil delivery from ICE 10 to lower sump 50. This difference in oil transfer rates can be caused at least in part by the multiple transfer stages from ICE 10 to lower sump 50 (i.e., from ICE 10 to windage tray 80, from windage tray 80 to drip tray 70, and from drip tray 70 to oil chimney 60), no or little oil present on one or more of the windage tray 80 and drip tray 70, oil transfer from ICE 10 to upper sump 40, and the transfer of oil from ICE 10 to lower sump 50 via gravity rather than by pump. Further, during cold starts the higher viscosity of oil further slows the rate of transfer from ICE 10 to lower sump 50. Accordingly, the valve-controlled orifice 44 is maintained 110 in an open position for the draw down duration in order to ensure the lower sump 50 is suitably supplied with oil during the draw down duration. An open position can comprise an at least partially open position, or a substantially open position in some embodiments. In some embodiments, maintaining 110 the valve-controlled orifice 44 in an open position can further comprise actuating the valve-controlled orifice 44 from a substantially closed position to an at least partially open position.

The draw down duration occurs temporally proximate the ICE 10 cold start event, and at least a portion of the draw down duration can occur after the ICE 10 cold start event. In other words, the valve-controlled orifice 44 can be configured in an at least partially open position prior to the ICE 10 cold start event. The draw down duration can comprise a predetermined (e.g., pre-calibrated) duration, or can be determined based on one or more operating characteristics of system 1. In some embodiments, the draw down duration comprises about 1 to about 5 seconds. In some embodiments, the draw down duration comprises a period of time sufficient to allow the rate of oil transfer from ICE 10 to lower sump 50 to achieve a rate equal to, or substantially equal to, the rate of oil extraction from lower sump 50 to ICE 10 via the oil pump conduit 31. In some embodiments, the draw down duration comprises a period of time sufficient to allow the combined rate of oil transfer from ICE 10 to lower sump 50 via oil chimney 60 and upper sump 40 to lower sump 50 via bleed hole 46 to achieve a rate equal to, or substantially equal to, the rate of oil extraction from lower sump 50 to ICE 10 via the oil pump conduit 31. In some embodiments, the rate of oil extraction from lower sump 50 to ICE 10 via the oil pump conduit 31 comprises an average operating rate over a period of time. For example, the average rate can be determined over a period of one minute. In some embodiments, the draw down duration comprises an amount of time required for the oil to achieve a minimum temperature and/or viscosity threshold. The temperature and/or viscosity of the oil can be measured at or proximate to one or more of lower sump 50, oil pump conduit 31, an ICE 10 discharge point (i.e., proximate windage tray 80), or oil chimney 60. Temperature can be measured by a temperature sensor (not shown), for example.

During the draw down duration, oil is circulated 120 between ICE 10 and reservoir 14, wherein oil extracted from lower sump 50 by oil pump conduit 31 is replaced by oil discharged from ICE 10 and communicated to lower sump 50 by oil chimney 60, and by oil communicated from upper sump 40 via valve-controlled orifice 44 and optionally bleed hole 46. Bleed hole 46 can further prevent or minimize a vacuum from developing within lower sump 50 during oil circulation 120. Subsequent to the draw down duration, valve-controlled orifice 44 is actuated 130 to a closed position for the warmup duration, and oil extracted from lower sump 50 by oil pump conduit 31 is replaced entirely, or substantially, by oil discharged from ICE 10 and communicated to lower sump 50 by oil chimney 60. In some embodiments, valve-controlled orifice 44 is actuated 130 to a substantially closed position for the warmup duration. Accordingly, a reduced volume of oil is circulated between lower sump 50 and ICE 10 such that the oil is more rapidly heated and ICE efficiency is increased. Further, many ICEs include a coolant circulation system (not shown) capable of extract heat from and ICE and delivering heat to an ICE. After a cold start event, coolant, heated by a heating device (not shown), can be used to deliver heat to the ICE. Accordingly, the reduced volume of oil circulated between lower sump 50 and ICE 10 extracts less heat from the coolant and improves the heating device performance.

The warmup duration can comprise a predetermined (e.g., pre-calibrated) duration, or can be determined based on one or more operating characteristics of system 1. In some embodiments, the warmup duration comprises up to about 200 seconds, up to about 300 seconds, or up to about 400 seconds, for example. In some embodiments, the warmup duration comprises an amount of time required for the oil to achieve a minimum temperature and/or viscosity threshold. The temperature and/or viscosity of the oil can be measured at or proximate to one or more of lower sump 50, oil pump conduit 31, for example. Temperature can be measured by a temperature sensor (not shown), for example. The measured temperature will ideally represent an average temperature of the oil in lower sump 50, in some embodiments. The temperature threshold can comprise a desired operating temperature of the oil, and can vary based upon the various characteristics of ICE 10 and an appurtenant vehicle. For example, the temperature threshold can be about 80° C., about 90° C., or about 100° C. Similarly, the temperature threshold can comprise a temperature at which ICE 10 efficiency is suitable. Subsequent to the warmup duration, the temperature of oil in upper sump 40 will be lower than the temperature of oil in lower sump 50. Accordingly, the temperature threshold can be set above the desired operating temperature of oil, such that when the valve-controlled orifice 44 is actuated 140 to an open position subsequent to the warmup duration, the colder oil of the upper sump 40 combines with the warmer oil of lower sump 50 to achieve a desired combined oil temperature within reservoir 14. For example, a larger volume disparity between upper sump 40 and lower sump 50 can require a higher temperature threshold.

In some instances during the warmup duration, a need for increased oil delivery from reservoir 14 to ICE 10 may arise, and such a need may exceed the oil communicating ability of lower sump 50. Accordingly, method 100 can optionally further comprise actuating 150 valve-controlled orifice 44 to an open position during the warmup duration in response to an increased oil demand event. The valve-controlled orifice 44 open position can comprise an at least partially open position. For example, the power output of ICE 10 can be controlled by a throttle (not shown), and the position of the throttle actuator can be monitored by a throttle position sensor. Higher ICE power output can require higher ICE oil demand event. Accordingly, in one embodiment, an increased ICE oil demand event comprises the throttle position sensor exceeding a position threshold. In another example, ICE 10 can power a vehicle, and the vehicle can be controlled by a brake system. Vehicle braking can increase ICE oil demand and impact (e.g., reduce) oil levels within reservoir 14, and particularly within lower sump 50. Insufficient oil levels within lower sump 50 can prevent or impair sufficient oil delivery to ICE 1, such as by falling below the level at which oil pump conduit 31 inlet end 33 fluidly communicates with lower sump 50. Accordingly, in one embodiment, an increased ICE oil demand event comprises a braking event in which the vehicle brake system is actuated, or actuated to an increased degree relative to a starting position. In another example, increased rotations per unit time (e.g., rotations per minute) of crankshaft 24 can increase ICE 10 oil demand event. Accordingly, in one embodiment, an increased ICE oil demand event comprises crankshaft 24 exceeding a minimum rotations per unit time threshold. For example, the rotations per minute threshold can comprise about 3,000.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, embodiments described as less desirable than other embodiments or prior art implementations with respect to one or more characteristics are not outside the scope of the disclosure and can be desirable for particular applications.

The invention claimed is:

1. An oil reservoir comprising: an upper sump defined by a sump bottom and one or more side walls, and including an at least partially open top end capable of receiving oil; a lower sump disposed vertically below the upper sump including a top end contiguous with at least a portion of the upper sump bottom; a valve-controlled orifice penetrating the upper sump bottom and including an actuatable waste gate capable of communicating oil collected in the upper sump to the lower sump; an oil chimney having an inlet end capable of receiving oil and a discharge end in fluid communication with the lower sump and capable of providing oil thereto; a drip tray disposed above the upper sump and configured to receive oil and communicate at least a portion of the collected oil to the inlet end of the oil chimney, and an oil pump conduit having an inlet end disposed within the lower sump, and capable of extracting oil therefrom, wherein the actuatable wastegate is actuated to communicate oil collected in the upper sump to the lower sump in response to an increased oil demand event, an end of an ICE oil circulation system warmup duration, and/or the temperature of oil in the lower sump exceeding a minimum temperature threshold.

2. The oil reservoir of claim 1, further comprising a drip tray disposed proximate the open top end of the upper sump and at least partially between the open top end and the upper sump bottom, wherein the drip tray is capable of collecting at least a portion of oil communicated to the upper sump open top end and further capable of communicating the collected oil to the oil chimney.

3. The oil reservoir of claim 2, further comprising a windage tray disposed above the drip tray relative to the upper sump, and capable of communicating oil to the drip tray.

4. The oil reservoir of claim 1, wherein the upper sump bottom further includes a bleed hole capable of establishing fluid communication between the upper sump and the lower sump.

5. The oil reservoir of claim 1, wherein the lower sump has a smaller fluid capacity than the upper sump.

6. An internal combustion engine (ICE) oil circulation system, comprising:

an ICE capable of receiving and discharging oil; and an oil reservoir including:

an upper sump defined by a sump bottom and one or more side walls, and including an at least partially open top end capable of receiving oil from the ICE;

a lower sump disposed vertically below the upper sump including a top end contiguous with at least a portion of the upper sump bottom;

a valve-controlled orifice penetrating the upper sump bottom and including an actuatable wastegate capable of communicating oil collected in the upper sump to the lower sump;

an oil chimney having an inlet end capable of receiving oil and a discharge end in fluid communication with the lower sump, and capable of providing oil thereto;

a drip tray disposed above the upper sump and configured to receive oil and communicate at least a portion of the collected oil to the inlet end of the oil chimney; and an oil pump conduit having an inlet end disposed within the lower sump, and configured to extract oil from the lower sump and communicate the same to the ICE;

wherein the actuatable wastegate is actuated to communicate oil collected in the upper sump to the lower sump in response to an increased oil demand event, an end of an ICE oil circulation system warmup duration, and/or the temperature of oil in the lower sump exceeding a minimum temperature threshold.

7. The ICE oil circulation system of claim 6, further comprising a drip tray disposed proximate the open top end of the upper sump and at least partially between the open top end and the supper sump bottom, wherein the drip tray is capable of collecting at least a portion of oil communicated to the oil reservoir proximate the upper sump open top end and further capable of communicating the collected oil to the oil chimney.

8. The ICE oil circulation system of claim 7, further comprising a windage tray disposed above the drip tray relative to the upper sump, and capable of communicating oil to the drip tray.

9. The ICE oil circulation system of claim 6, wherein the upper sump bottom further includes a bleed hole capable of establishing fluid communication between the upper sump and the lower sump.

10. The ICE oil circulation system of claim 6, wherein one of more of the drip tray or oil reservoir is angled such that at least a portion of the oil collected by the drip tray is directed to the oil chimney by virtue of gravity.

11. A method for operating an internal combustion engine (ICE) oil circulation system, wherein the system includes an ICE capable of receiving and discharging oil, and an oil reservoir including an upper sump defined by a sump bottom and one or more side walls and including an at least partially open top end capable of receiving oil from the ICE, a lower sump disposed vertically below the upper sump including a top end contiguous with at least a portion of the upper sump bottom, a valve-controlled orifice penetrating the upper sump bottom and including an actuatable wastegate capable of communicating oil collected in the upper sump to the lower sump by actuating to and/or between one or more of an open position and a closed position, an oil chimney having an inlet end capable of receiving oil and a discharge end in fluid communication with the lower sump and capable of providing oil thereto, a drip tray disposed above the upper sump and configured to receive oil and communicate at least a portion of the collected oil to the inlet end of the oil chimney, and an oil pump conduit having an inlet end disposed within the lower sump and configured to extract oil from the lower sump and communicate the same to the ICE, wherein the actuatable wastegate is actuated to communicate oil collected in the upper sump to the lower sump in response to an increased oil demand event, an end of an ICE oil circulation system warmup duration, and/or the temperature of oil in the lower sump exceeding a minimum temperature threshold, the method comprising: maintaining the valve-controlled orifice in an at least partially open position for a draw down duration temporally proximate an ICE cold start event, wherein at least a portion of the draw down duration occurs after the cold start event; circulating oil between the ICE and the oil reservoir via the oil pipe conduit after the ICE cold start event; actuating the valve-controlled orifice to a substantially closed position subsequent to the draw down duration for a warmup duration; and actuating the valve-controlled orifice to an at least partially open position subsequent to the warmup duration.

12. The method of claim 11, wherein the draw down duration comprises a period of time sufficient to allow a rate of oil transfer from the ICE to the lower sump via the oil chimney to achieve a rate substantially equal to a rate of oil extraction from the lower sump via the oil pipe conduit.

13. The method of claim 12, wherein the rate of oil extraction from the lower sump via the oil pipe conduit comprises an average rate measured over a period of time.

14. The method of claim 11, wherein the draw down duration expires after the oil achieves a minimum temperature and/or viscosity threshold.

15. The method of claim 11, wherein the warmup duration expires after the oil achieves a minimum temperature and/or viscosity threshold.

16. The method of claim 11, wherein maintaining the valve-controlled orifice in an at least partially open position further comprises actuating the valve-controlled orifice from a substantially closed position to an at least partially open position.

17. The method of claim 11, further comprising actuating the valve-controlled orifice to an open position during the warmup duration in response to an increased oil demand event.

18. The method of claim 17, wherein the ICE oil circulation system is controlled by a throttle and the throttle is monitored by a throttle position sensor, and the increased oil demand event comprises the throttle position sensor exceeding a position threshold.

19. The method of claim 17, wherein the ICE oil circulation system powers a vehicle and the vehicle is controlled by a brake system, and the increased oil demand event comprises a braking event.

20. The method of claim 17, wherein the ICE oil circulation system includes a crankshaft, and the increased oil demand event comprises the crankshaft exceeding a rotations per minute threshold.

* * * * *